US011199311B2

(12) United States Patent
Gastineau et al.

(10) Patent No.: US 11,199,311 B2
(45) Date of Patent: Dec. 14, 2021

(54) LIGHTING DEVICE FOR EXPLOSIVE ATMOSPHERES

(71) Applicant: ABB SCHWEIZ AG, Baden (CH)

(72) Inventors: Fabien Gastineau, Valencin (FR); Fabrice Martins, Oullins (FR)

(73) Assignee: ABB SCHWEIZ AG, Baden (CH)

( * ) Notice: Subject to any disclaimer, the term of this patent is extended or adjusted under 35 U.S.C. 154(b) by 0 days.

(21) Appl. No.: 17/079,473

(22) Filed: Oct. 24, 2020

(65) Prior Publication Data

US 2021/0123583 A1 Apr. 29, 2021

(30) Foreign Application Priority Data

Oct. 29, 2019 (EP) ..... 19205921

(51) Int. Cl.

| | |
|---|---|
| ***F21V 15/01*** | (2006.01) |
| ***F21V 29/503*** | (2015.01) |
| ***F21V 3/06*** | (2018.01) |
| ***F21V 23/00*** | (2015.01) |
| *F21Y 115/10* | (2016.01) |

(52) U.S. Cl.

CPC ..... *F21V 15/01* (2013.01); *F21V 3/06* (2018.02); *F21V 23/004* (2013.01); *F21V 29/503* (2015.01); *F21Y 2115/10* (2016.08)

(58) Field of Classification Search

CPC ..... F21V 15/01; F21V 29/503; F21V 3/06; F21V 23/004; F21V 23/009; F21V 17/101; F21V 31/005; F21V 5/007; F21V 25/12; F21Y 2115/10; F21Y 2105/10

See application file for complete search history.

(56) References Cited

U.S. PATENT DOCUMENTS

| | | | | |
|---|---|---|---|---|
| 6,220,719 | B1 * | 4/2001 | Vetorino | F21L 13/06 362/192 |
| 2010/0254135 | A1 * | 10/2010 | Bayat | F21V 23/0414 362/235 |
| 2016/0327237 | A1 | 11/2016 | Hoch et al. | |
| 2017/0082279 | A1 * | 3/2017 | Manahan | F21V 31/005 |
| 2017/0307204 | A1 * | 10/2017 | Cattoni | F21V 25/12 |
| 2017/0343185 | A1 | 11/2017 | Fieberg et al. | |

FOREIGN PATENT DOCUMENTS

DE 202017105803 U1 1/2019

* cited by examiner

*Primary Examiner* — Kevin Quarterman
(74) *Attorney, Agent, or Firm* — Craft Chu PLLC; Andrew W. Chu

(57) ABSTRACT

The LED lighting device for explosive atmospheres has an optical chamber accommodating an optical system, at least one LED mounted on a printed circuit board, a lens covering the printed circuit board, and a control chamber accommodating a supply device of the printed circuit board and control device of the supply device. The optical chamber and the control chamber extend within a closed enclosure to withstand any impacts coming from the environment outside the lighting device or coming from the optical chamber and/or the control chamber. The lens of the optical system is defined by a silicone lens that is an integral part of the enclosure.

10 Claims, 1 Drawing Sheet

LIGHTING DEVICE FOR EXPLOSIVE ATMOSPHERES

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The invention relates to the field of lighting devices for explosive atmospheres according to the "ATEX" standard (Appareils destinés à être utilisés en ATmosphéres EXplosives", French for Equipment intended for use in EXplosive ATmospheres).

2. Description of Related Art Including Information Disclosed Under 37 CFR 1.97 and 37 CFR 1.98

In a known manner, the latter is imposed on all industrial sites, for example oil platforms, metal transformation workshops, or grain storage silos, etc., where activities take place resulting in the emission of a large concentration of flammable particles into the ambient air.

The ATEX standard specifies, inter alia, the criteria that the electrical equipment installed on such sites must satisfy. In this context, it very strictly regulates the structure of the authorized lighting devices. For the latter, one aim being to avoid explosions and/or the propagation of uncontrollable fires, the ATEX standard requires the implementation of means capable of reliably insulating the electrical parts that may generate sparks, from the outside environment. Furthermore, still according to this standard, a technical solution must be provided, making it possible to guarantee that luminaires are kept in working order, including if an accident occurs, in order to avoid any worsening of the situation due to untimely darkness.

Luminaires simultaneously complying with these criteria and specifically studied to be suitable for different applications have thus been developed, such that currently, a whole line of products is commercially available, dedicated to the main needs of the concerned activity branches.

This offering includes a certain number of LED luminaires, allowing companies subject to the ATEX standard to have not only products satisfying the latter, but also to benefit from the many advantages procured by LED technology, in particular in terms of light performance, electrical consumption, and longevity In LED lighting devices, according to the ATEX standard and currently on the market, the optical system is commonly covered by a thick glass plate or accommodated inside a thick glass tube allowing it to be protected from impacts and making it possible to prevent any accidents caused by a spark emanating from the luminaire.

It has, however, been noted upon use that the presence of this thick glass protection has the drawbacks of reducing the efficacy of the optical system, making the luminaire heavier to the point of complexifying its installation, and significantly increasing its cost.

BRIEF SUMMARY OF THE INVENTION

The aim of the present invention is to offset these various drawbacks and to propose a lighting device for explosive atmospheres, based on LED technology, according to the ATEX standard, for which the precision and the diffusion efficacy of the optical system are preserved, with a simpler installation and limited cost.

To that end, the invention relates to an LED lighting device for explosive atmospheres, having an optical chamber accommodating an optical system comprising at least one LED mounted on a printed circuit board and a lens covering said printed circuit board, as well as a control chamber accommodating supply means of the printed circuit board and control means of the supply means, said optical chamber and said control chamber extending within a closed enclosure designed to be able to withstand any impacts coming from the environment outside the lighting device or coming from the optical chamber and/or the control chamber characterized in that said lens of the optical system is defined by a silicone lens that is an integral part of said enclosure.

According to a first feature of this device, the enclosure comprises a metal profile molded to have a first cavity where the optical chamber extends, and a second cavity where the control chamber extends, said silicone lens being connected to said profile so as to close said optical chamber.

Another feature is defined by the fact that said enclosure further includes at least one cover connected to the metal profile so as to close said control chamber.

According to one preferred embodiment variant, the metal profile includes two side wings between which the control chamber extends, connected to one another by a bottom wall, a portion of which recessed toward the control chamber defines said first cavity.

In this case, according to one additional feature, the recessed portion includes an inner face and an outer face having a central area, against which said printed circuit board is fastened, and which is bordered by two grooves molded to receive tabs of complementary shape included by said silicone lens covering said printed circuit board.

It has also been conceived that the silicone lens is secured to said metal profile using a metal frame nested in the recessed portion and molded to overlap the tabs of the silicone lens accommodated in said grooves as well as side areas of the outer face of the recessed portion.

In this case, the space comprised between the tabs of the silicone lens and said metal frame is filled in using a sealing joint that may consist of a silicone glue.

According to another feature, the metal profile and the metal frame are made from aluminum and are assembled using screws.

The device according to the invention is further characterized in that the inner face of the recessed portion is molded so as to define means for cooling the printed circuit board.

BRIEF DESCRIPTION OF THE SEVERAL VIEWS OF THE DRAWINGS

The advantages resulting from the present invention will appear upon reading the following description relative to an exemplary embodiment illustrated in the attached drawings.

DETAILED DESCRIPTION OF THE INVENTION

Figure 1:
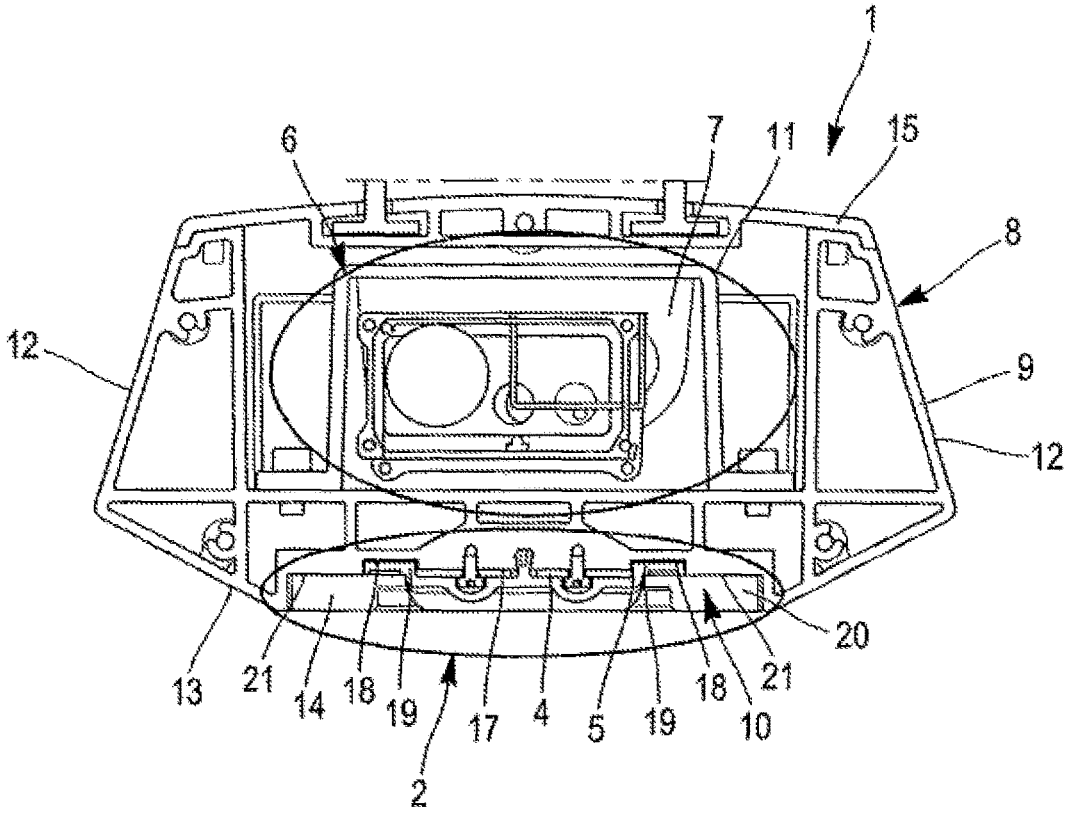
FIG. 1 illustrates a cross-sectional view of a lighting device according to the invention.

As shown in FIG. 1, the present invention relates to an LED lighting device 1 for explosive atmospheres, conventionally having an optical chamber 2 housing an optical system comprising a plurality of LEDs 3 mounted on a printed circuit board 4 and a lens 5 covering the printed circuit board 4, as well as a control chamber 6 accommodating a housing 7 incorporating supply means of the printed circuit board 4 and control means of the supply means.

As illustrated in FIG. 1, the optical chamber 2 and the control chamber 6 are delimited by a closed enclosure 8, the structure of which is specifically studied on the one hand to withstand any impacts that may come from the environment outside the lighting device 1 and on the other hand to allow the retention within the lighting device 1 of any spark coming from the optical chamber 2 and/or the control chamber 6. In short, the enclosure 8 is designed in order to satisfy the ATEX standard and has anti-explosion properties.

In the illustrated embodiment variant, the enclosure 8 comprises a metal profile 9 made from extruded aluminum molded to have a first cavity 10 where the optical chamber 2 extends, and a second cavity 11 where the control chamber 6 extends. More specifically, the profile 9 includes two side wings 12, between which the second cavity 11 accommodating the control chamber 6 extends, and which are connected to one another, at their lower ends, by a bottom wall 13, a portion 14 of which recessed toward the control chamber 10 defines the first cavity 10. A cover 15, connecting the upper ends of the side wings 12 of the profile 9 to one another, makes it possible to close the control chamber 6.

According to the invention, the lens 5 is defined by a silicone lens and covers the optical chamber 2 while being directly integrated into the closed enclosure 8.

Figure 2:
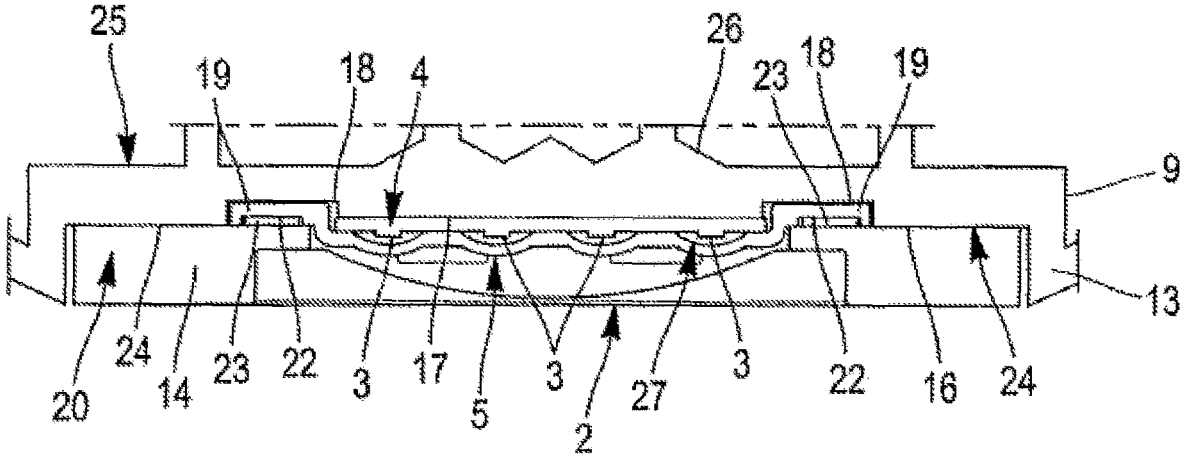
FIG. 2 illustrates an enlarged view of the optical chamber of the device shown in FIG. 1.

To that end, in reference to FIG. 2, the silicone lens 5 and the recessed portion 14 include means for assembling the lens 5 on the profile 9. Indeed, the recessed portion 14 has an outer face 16, including a central zone 17 against which the printed circuit board is fastened, for example using screws, and two grooves 18 bordering the central area 17. As illustrated, the two grooves 18 are molded to accommodate, by nesting, tabs 19 of complementary appearance included by the silicone lens 5 that covers the printed circuit board 4 and closes the optical chamber 2.

Furthermore, the silicone lens 5 is secured to the metal profile 9 using an aluminum frame 20 nested in the recessed portion 14 and molded to overlap the tabs 19 of the silicone lens 5 accommodated in said grooves 18 as well as side areas 21 of the outer face 16 of the recessed portion 14.

In order to strengthen this connection, the tabs 19 each include a slot 22, formed in their outer face intended to be oriented toward the frame 20, in which a sealing joint 23 is deposited that may consist of a silicone glue. This joint 23 makes it possible to fill in the space comprised between the tabs 19 of the silicone glue 5 and said frame 20, and thus contributes to reliably insulating the lighting device 1 from the surrounding environment.

It should be noted in this regard that the profile 9 and the frame 20 are assembled by screwing under controlled pressure, and are each made from an aluminum material with a particular roughness, chosen to obtain a junction 24 with explosionproof properties after they are assembled.

Furthermore, in order to contribute to such characteristics, the inner face 25 of the recessed portion 14 is molded so as to define cooling means 26 of the printed circuit board 4 provided with LEDs 3. It thus emerges from the preceding that the lighting device 1 according to the invention has a structure making it possible to achieve the aims described above. The integration of the lens 5 made from a silicone material into the optical system as component element of the closed enclosure 8 makes it possible to avoid the use of a thick protective glass window. Thus, the efficacy and the lighting precision of the optical system are preserved and a particularly lightweight lighting device 1 is obtained. Such a property further has the effect of simplifying the installation of the lighting device 1 according to the invention and reducing the overall cost thereof. Furthermore, the use of a silicone lens 5 makes it possible to provide, for the optical chamber 2, an inner volume 27 of very small size and therefore minimizing the force of any explosion coming from the optical chamber 2, by confining it and keeping it within the latter.

We claim:

1. A light emitting diode (LED) lighting device for explosive atmospheres, having an optical chamber accommodating an optical system comprising:

at least one LED mounted on a printed circuit board and a lens covering said printed circuit board, as well as a control chamber accommodating supply means of the printed circuit board and control means of the supply means, said optical chamber and said control chamber extending within a closed enclosure to withstand any impacts coming from the environment outside the lighting device or coming from the optical chamber and/or the control chamber, wherein said lens of the optical system is defined by a silicone lens that is an integral part of said enclosure.

2. The device according to claim 1, wherein the enclosure comprises a metal profile molded to have a first cavity where the optical chamber extends, and a second cavity where the control chamber extends, said silicone lens being connected to said profile so as to close said optical chamber.

3. The device according to claim 2, wherein said enclosure further comprises at least one cover connected to the metal profile so as to close said control chamber.

4. The device according to claim 2, wherein the metal profile comprises two side wings between which the control chamber extends, connected to one another by a bottom wall, a portion of which recessed toward the control chamber defines said first cavity.

5. The device according to claim 4, wherein the recessed portion comprises an inner face and an outer face having a central area, against which said printed circuit board is fastened, said central area being bordered by two grooves molded to receive tabs of complementary shape included by said silicone lens covering said printed circuit board.

6. The device according to claim 5, wherein the silicone lens is secured to said metal profile using a metal frame nested in the recessed portion and molded to overlap the tabs of the silicone lens accommodated in said grooves and side areas of the outer face of the recessed portion.

7. The device according to claim 6, wherein the space comprised between the tabs of the silicone lens and said metal frame is filled in using a sealing joint.

8. The device according to claim 7, wherein the sealing joint is comprised of a silicone glue.

9. The device according to claim 6, wherein the metal profile and the metal frame comprised of aluminum and are assembled using screws.

10. The device according to claim 5, wherein the inner face of the recessed portion is molded so as to define means for cooling the printed circuit board.

* * * * *